US006382460B1

(12) United States Patent
González

(10) Patent No.: US 6,382,460 B1
(45) Date of Patent: May 7, 2002

(54) FLAT ARTICLE DISPENSING DEVICE

(75) Inventor: Luis Aira González, Abrera (ES)

(73) Assignee: Fischer Iberica, S.A., Tarragona (ES)

( * ) Notice: Subject to any disclaimer, the term of this patent is extended or adjusted under 35 U.S.C. 154(b) by 0 days.

(21) Appl. No.: 09/674,836

(22) PCT Filed: Feb. 25, 2000

(86) PCT No.: PCT/ES00/00067

§ 371 Date: Nov. 7, 2000

§ 102(e) Date: Nov. 7, 2000

(87) PCT Pub. No.: WO00/53073

PCT Pub. Date: Sep. 14, 2000

(30) Foreign Application Priority Data

Mar. 9, 1999 (ES) ..... 9900602 U

(51) Int. Cl.[7] ..... B65H 1/08
(52) U.S. Cl. ..... 221/232; 221/268
(58) Field of Search ..... 221/33, 36, 41, 221/45, 56, 226, 232, 268, 271

(56) References Cited

U.S. PATENT DOCUMENTS 3,228,554 A 1/1966 Huffman
5,975,349 A * 11/1999 Menes ..... 221/268

FOREIGN PATENT DOCUMENTS

| | | |
|---|---|---|
| DE | 429635 | 6/1926 |
| DE | 28 25 352 A1 | 12/1979 |
| DE | G 86 09 412.2 | 7/1986 |
| EP | 0 506 243 A1 | 9/1992 |
| ES | 165740 U | 5/1971 |
| ES | 1 024 259 U | 8/1993 |

* cited by examiner

*Primary Examiner*—Kenneth W. Noland
(74) *Attorney, Agent, or Firm*—Finnegan, Henderson, Farabow, Garrett & Dunner, L.L.P.

(57) ABSTRACT

The invention discloses a device for dispensing flattened articles which may be operated with one hand alone, comprising a container (2) housed in a holder (4) having an open-mouth (5), which urged by a spring (6) forcing it against a retractable stop (7) and holding it flush with the open mouth (5). The holder (4) has attached to the rear wall (9) one end of the spring (6) and a tab (10) which is at the same level as a rear opening (11) through which it can penetrate, formed in the inner smaller side (12) of the container (2) over the level of the lower larger side (13) thereof. The opening (11) is slightly higher than the thickness of the tab (10) and equivalent to the thickness of the article (3), and mates with another front opening (14) which is slightly higher than the article (3) and slightly longer than the width thereof.

12 Claims, 2 Drawing Sheets

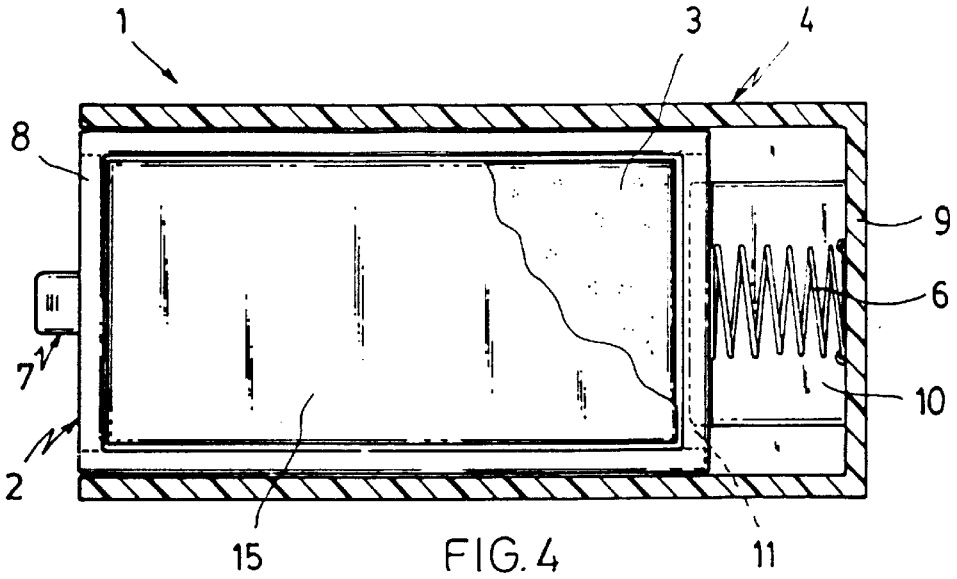
FIG. 4
FIG. 5
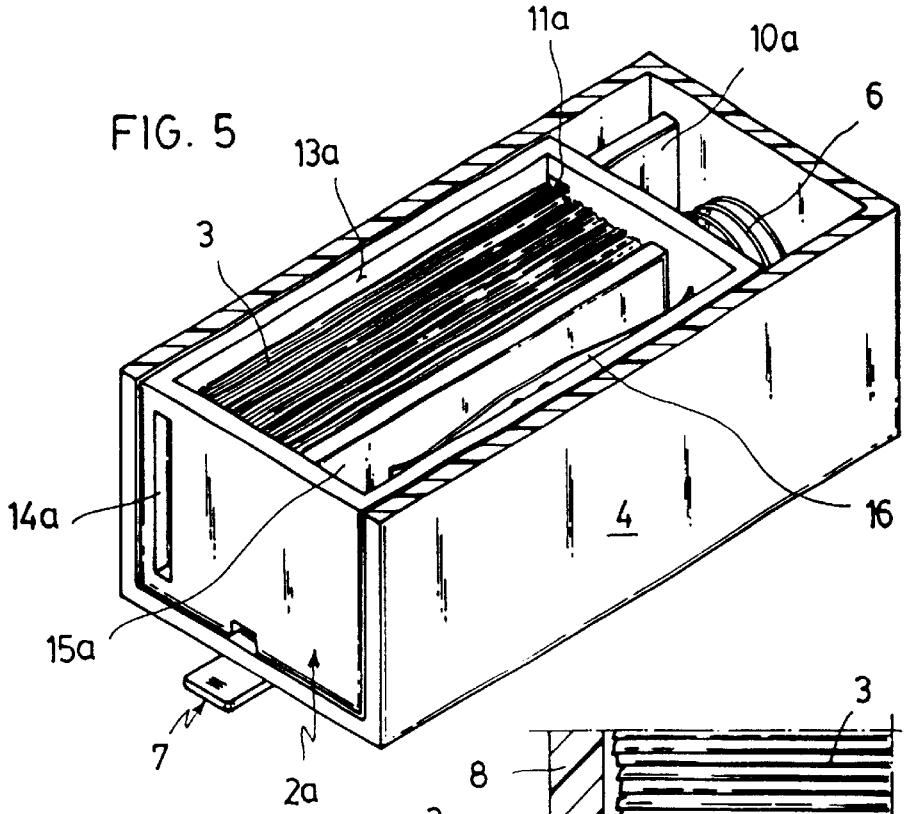
FIG. 6
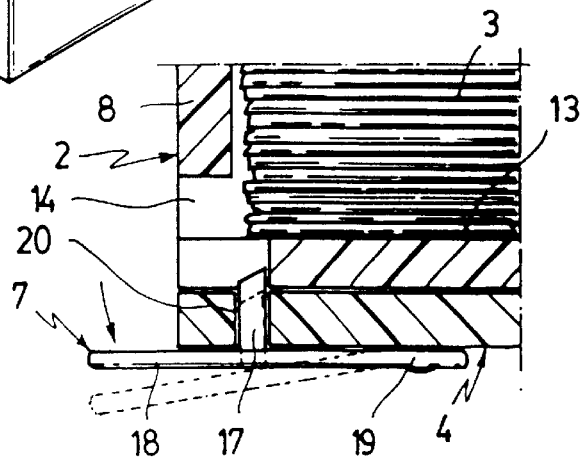

FLAT ARTICLE DISPENSING DEVICE

DESCRIPTION

1. Field of the Invention

This invention relates to a device for dispensing flattened articles, such as paper handkerchiefs, paper serviettes, boxes of moist towels and the like, and more particularly to a device allowing the articles to be placed one by one within the reach of the user's hand, while operating the device with one hand alone.

2. State of the Art

Currently, paper handkerchiefs are sold independently folded and stacked in pocket packs containing a small number of handkerchiefs, or in table-top boxes containing a large number of handkerchiefs folded in interleaved fashion, whereby the removal of one of them causes the following one to be positioned in a way easy to take by the hand.

These packaging arrangements of paper handkerchiefs suffer the drawback that both hands must be used to remove a handkerchief, since in the pocket packs, the pack is simply a bag, with a closure flap, which must be taken in one hand to open the closure flap and remove the handkerchief with the other, both hands also being required to close the pack. Likewise, in the table-top boxes, in view of the light weight of the item, it is also necessary to use both hands to remove a handkerchief, one to take hold of the handkerchief and the other to hold the box and overcome the resistance of removing the handkerchief and positioning the next one in an accessible way.

This drawback becomes more acute when the user of the handkerchief is the driver of a motor vehicle, in which case the operation of withdrawing a paper handkerchief from its pack is a driving risk, since he performs it while holding the steering wheel at the same time, with the inevitable loss of control and attention, or temporarily abandons the steering wheel, which is even worse. To try and perform this operation with one hand alone is not impossible, but requires great skill and seriously reduces the driver's attention.

Furthermore, where a motor vehicle is concerned, the handkerchief packs or boxes are usually exposed to dust and pollution, since in many cases there is no suitable place to locate them, or when there is, it usually consists of the glove box, a housing in the arm-rest between the front seats, etc, requiring an obviously risky additional maneuver, such as opening the lid of the distant glove box, of the arm-rest, etc., to reach the handkerchief pack or box and remove them from their lodging so as then to remove the handkerchiefs one at a time.

It would, therefore, be desirable for it to be possible to reach a single paper handkerchief and other similar items using one hand alone and without having to pay special attention to the operation, at the same time as they are located in an accessible position, unaffected by the environmental pollution.

SUMMARY OF THE INVENTION

With a view to achieving the foregoing purpose, the solution has been adopted of using dispensing means which, when operated by one hand alone, automatically deliver one unit of the article to be dispensed, comfortably within reach of the same hand.

In accordance with the foregoing premises, the dispensing device of the invention has been developed, which device comprises a container for the articles which is preferably parallelepipedic in shape and which, being capable of sliding in an open-mouthed holder of greater length than the said container, is urged by a spring forcing it against a retractable stop and holding it flush with the open mouth of the holder, the latter having fixedly attached to the wall thereof opposite the said open mouth, a spring end and a projecting tab, parallel to the plane of sliding of the container, which is at the same level as a rear opening through which it can penetrate, formed in the inner smaller side of the container above the level of the lower larger side thereof, the height of said opening being slightly greater than the thickness of the tab and equivalent to the thickness of the article, and mates with another front opening, similar to the former which, provided in the outer smaller side of the container, has a height slightly greater than the article and a length slightly greater than the width thereof.

It is a feature of the invention that the projecting tab penetrates to such a distance within the container, through the rear opening, that, when the container is pushed by the hand, it moves the article facing it in a space sufficient to allow the other end thereof to project through the front opening of the container in an amount sufficient to allow it to be seized by the hand, once the container, urged by the spring, has recovered the rest position thereof in which it is flush with the open mouth of the holder.

The invention contemplates that the width of the tab be the same as or smaller than the width of the article.

According to a preferred embodiment of the invention, the flattened articles to be dispensed one by one are arranged horizontally in a pile with a slight clearance around the perimeter thereof in the container, exiting therefrom through the front opening of the container, situated horizontally, and being lowered in the interior thereof by gravity and/or by pressure means, as the articles located directly on the inside bottom surface of the container are dispensed.

According to another embodiment of the invention, the set of flattened articles to be dispensed one by one is arranged vertically, resting on one of the edges thereof, in the container, exiting therefrom through the front opening of the container, situated vertically adjacent a wall of the container, and with the set of articles being urged against said wall under pressure from a plate urged by a spring.

It is contemplated that the holder be fitted with the retractable stop limiting the exit from the container, said stop being urged by a spring maintaining it in an active position and having manual means which, by overriding said spring, allow the container to be removed for refilling. The container is provided with an anvil in which the retractable stop engages.

BRIEF DESCRIPTION OF THE DRAWING

To facilitate an understanding of the foregoing ideas, the invention is described hereinafter, with reference to the accompanying drawings, in which:

FIG. 4 is a horizontal longitudinal cross section view of the device of the previous Figures in the rest position thereof.

FIG. 5 is a perspective view of a further embodiment of the device of the invention, in the rest position thereof and arranged for the vertical delivery of the flattened articles.

FIG. 6 is a cross section view of a detail of the exit limiting stop of the container relative to the holder.

DETAILED DESCRIPTION OF THE INVENTION

Figure 1:
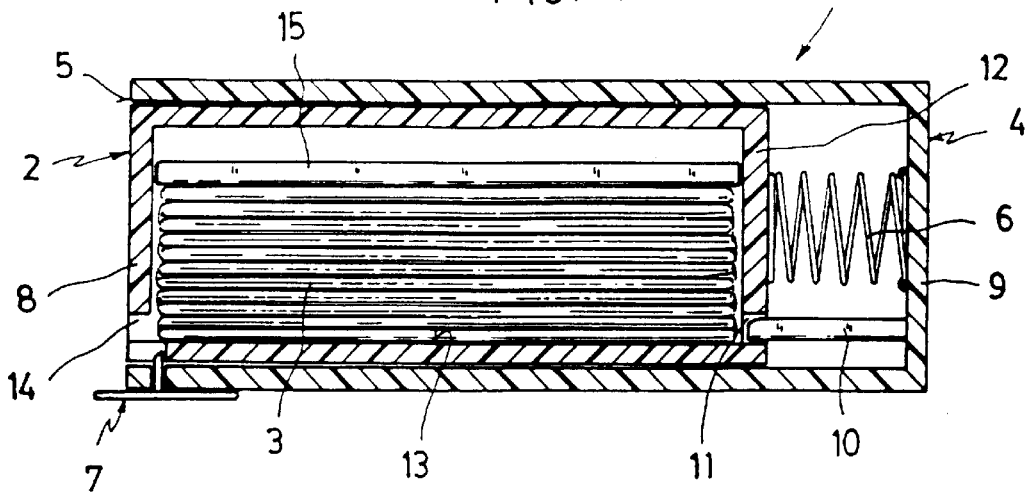
FIG. 1 is a vertical longitudinal cross section of a preferred embodiment of the flattened article dispensing device of the invention, in the rest position thereof and arranged for the horizontal delivery of such articles.

The dispensing device 1, as shown in FIG. 1, comprises a container 2 containing the articles 3. The container 2 is preferably parallelepipedic in shape and, being slidable in a holder 4 having an open mouth 5 and which is longer than the container 2, is urged by a spring 6 pressing it against a retractable stop 7 and holding the smaller front surface flush with the open mouth 5 of the holder 4.

The holder 4, as may also be seen in FIG. 1, has fixedly attached to the rear wall 9 thereof, opposite the open mouth 5, one end of the spring 6 and a projecting tab 10, parallel to the plane of sliding of the container 2, and which is at the same level as a rear opening 11, formed in the rear smaller surface 12 of the container 2 above the level of the larger bottom surface 13 thereof and through which it may penetrate. Said rear opening 11 has a height slightly greater than the thickness of the tab 10 and equivalent to the thickness of the article 3 and mates with a further front opening 14, similar to the former and which, formed in the smaller front surface 8 of the container, has a height and a length slightly greater than the thickness and the width of the article 3, respectively.

Figure 2:
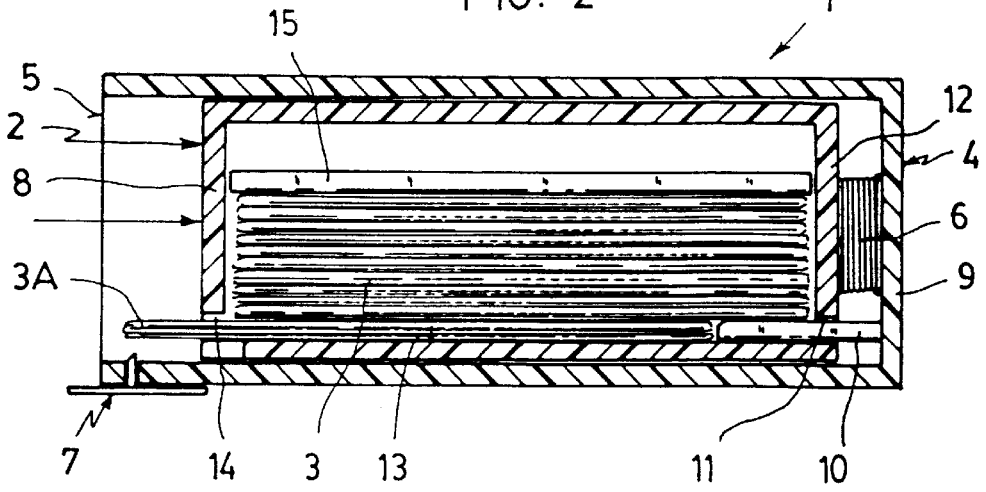
FIG. 2 is similar to FIG. 1, but showing the same device in a stage of selecting an article to be delivered.
Figure 3:
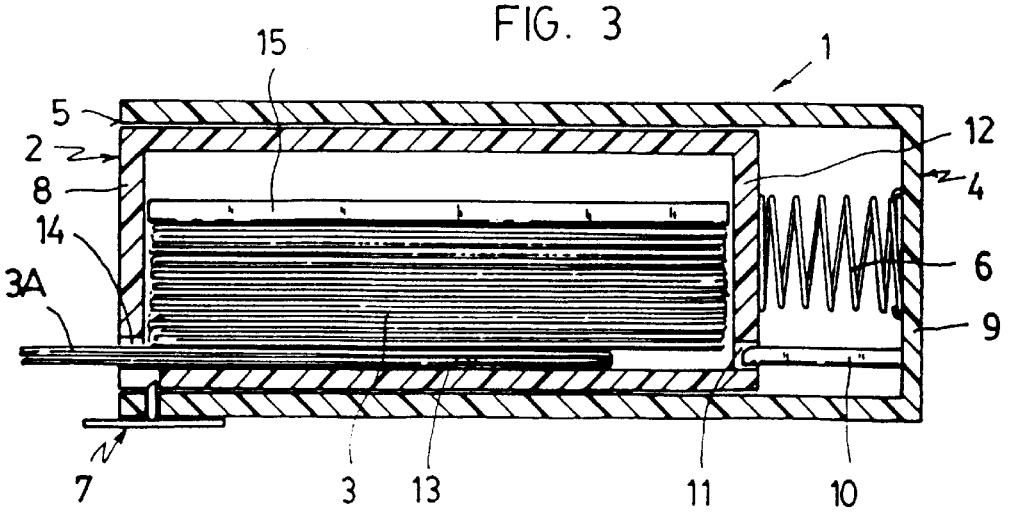
FIG. 3 shows, like FIGS. 1 and 2, the same device in the position of delivering the flattened article.

The projecting tab 10, as may be gathered from the selection stage of FIG. 2, penetrates in the container 2 through the rear opening 11 to such an extent that, when the container 2 is pushed with the hand in the direction of the arrow, it moves the article facing said rear opening 11 sufficiently for the other end 3A thereof to project through the front opening 14 of the container in a distance appropriate for it to be taken by the hand, once the container, urged by the spring 6, has recovered the delivery position thereof, as shown in FIG. 3, prior to the initial rest position of FIG. 1.

The width of the projecting tab 10, as may be seen in FIG. 4, is obviously the same or less than the width of the article. It may be formed by two or more thin coplanar tabs which simultaneously bear against the edge of the article 3.

According to the embodiment illustrated in FIGS. 1 to 4, the articles 3 are delivered one by one on a horizontal plane and, in this case, they are arranged in the container 2 in a horizontal pile with a slight clearance around the perimeter thereof. The articles 3 exit from the container through the front opening 14 thereof, situated in a horizontal position and are lowered in the interior thereof by gravity and/or with the aid of pressure means, such as a plate 15 of certain weight or a spring, as they are dispensed. The articles 3 are situated directly on the inner bottom wall 13 of the container 2.

According to a further embodiment of the invention, shown in FIG. 5, the set of flattened articles 3*a* to be dispensed one by one is arranged vertically, resting on one of the edges thereof, in the container 2*a*. The articles 3*a* exit from the container 2*a* through the front opening 14*a* thereof, situated vertically adjacent a wall 13*a* of the container 2*a*, and with said set of articles being urged against said wall 13*a* under pressure from a light-weight plate 15*a* urged by a spring 16.

The retractable stop arrangement 7 limiting the exit of the container 2–2*a* is mounted in the holder 4 and is formed by a stop member 17 associated with a leaf spring 18, attached in this case at 19 to the holder 4, with said stop member 17 projecting through the opening 20 of the holder, in such a way that it may be retracted by pushing the leaf spring 18 in the direction of the arrow.

Both the holder 4 and the container 2–2*a*, as also the open mouth 5 of the holder may be provided with openable covers which, in the case of the last named, must be an automatically opening cover. None of the said covers has been shown in the drawing.

The flattened articles 3–3*a* have been illustrated as individually folded paper handkerchiefs, nevertheless, they could be other products.

I claim:

1. A device for dispensing flattened articles, such as paper handkerchiefs, boxes of moist towels and the like, and more particularly to a device allowing the articles to be placed one by one within the reach of the user's hand, while operating the device (1) with one hand alone, characterized in that it comprises a container (2) containing the articles (3), which is preferably parallelepipedic in shape and which, being capable of sliding in a holder (4) having an open-mouth (5) and of greater length than said container (2), is urged by a spring (6) forcing it against a retractable stop (7) and holding it flush with the open mouth (5) of the holder (4), the latter having fixedly attached to the rear wall (9) thereof opposite the said open mouth (5), one end of the spring (6) and a projecting tab (10), parallel to the plane of sliding of the container (2), which is at the same level as a rear opening (11) through which it can penetrate, formed in the inner smaller side (12) of the container (2) over the level of the lower larger side (13) thereof, said opening (11) being slightly higher than the thickness of the tab (10) and equivalent to the thickness of the article (3), and mates with another front opening (14), similar to the former which, provided in the outer smaller side (8) of the container (2), is slightly higher than the article (3) and slightly longer than the width thereof.

2. The device of claim 1, characterized in that the projecting tab (10) penetrates to such a degree in the container (2), through the rear opening (11), that, when the container (2) is pushed by the hand, it moves the article (3) facing it in a space sufficient to allow the other end (3A) thereof to project through the front opening (14) of the container in an amount sufficient to allow it to be seized by the hand, after the container, urged by the spring (6), has recovered its rest position in which the it is flush with the open mouth of the holder.

3. The device of claim 1, characterized in that the width of the tab (10) is same as or smaller than the width of the article (3).

4. The device of claim 1, characterized in that the flattened articles (3) to be dispensed one by one are arranged horizontally in a pile with a slight clearance around the perimeter thereof in the container (2), exiting therefrom through the front opening (14) of the container (2), situated horizontally, and being lowered in the interior thereof by gravity, as the articles located directly on the inside bottom surface (13) of the container (2) are dispensed.

5. The device of claim 1, characterized in that the set of flattened articles (3*a*) to be dispensed one by one is arranged vertically, resting on one of the edges thereof in the container (2*a*), the articles (3*a*) exiting therefrom through the front opening (14*a*) of the container (2), situated vertically adjacent a wall (13*a*) of the container (2*a*), and with the set of articles being urged against said wall (13*a*) under pressure from a plate (15*a*) urged by a spring (16).

6. The device of claim 4, characterized in that the container (2) is provided with pressure means which add to the action of gravity to maintain the correct compactness of the set of flattened articles (3) piled therein and to ensure the one by one removal thereof.

7. The device of claim 6, characterized in that the pressure means consist of one of the group formed by weights and springs exerting a light, uniformly distributed load on the set of piled flattened articles.

8. The device of claim 1, characterized in that the holder (4) is provided with the retractable stop (7) limiting the removal of the container (2), which stop is urged by a spring maintaining it in the active position and has manual means which, overriding said spring, allow the container to be removed for refilling.

9. The device of claims 1 and 8, characterized in that the container (2) is provided with an anvil in which the retractable stop (7) engages.

10. The device of claim 1, characterized in that the container (2) is provided with an openable cover which protects the flattened articles (3) and allows access to the interior of the container (2) for refilling thereof with new articles (3).

11. The device of claim 1, characterized in that the holder (4) is provided with an openable cover in communication with the container (2) which, in this case, does not have an openable cover.

12. The device of claim 1, characterized in that the open mouth of the holder (4) may be closed by a protective cover of the automatically openable type.

* * * * *